US011267002B2

(12) United States Patent
Hsieh

(10) Patent No.: US 11,267,002 B2
(45) Date of Patent: Mar. 8, 2022

(54) DIVERTING APPARATUS OF A FAUCET

(71) Applicant: Yuan Pin Industrial Co., Ltd., Ho-Mei Township, Chang-Hua County (TW)

(72) Inventor: Ming-Chih Hsieh, Ho-Mei Township (TW)

(73) Assignee: Yuan Pin Industrial Co., Ltd., Ho-Mei Township (TW)

( * ) Notice: Subject to any disclaimer, the term of this patent is extended or adjusted under 35 U.S.C. 154(b) by 57 days.

(21) Appl. No.: 16/882,890

(22) Filed: May 26, 2020

(65) Prior Publication Data

US 2021/0370323 A1 Dec. 2, 2021

(51) Int. Cl.
*B05B 1/16* (2006.01)

(52) U.S. Cl.
CPC ..... *B05B 1/1645* (2013.01); *B05B 1/1636* (2013.01)

(58) Field of Classification Search
CPC ... E03C 1/023; E03C 2201/30; B05B 1/1636; B05B 1/1645
USPC ..... 239/444, 445, 581.1; 137/625.46, 625.47
See application file for complete search history.

(56) References Cited

U.S. PATENT DOCUMENTS

| | | | | |
|---|---|---|---|---|
| 6,082,624 | A * | 7/2000 | Heinzelmann | E03C 1/023 137/872 |
| 7,509,976 | B2 * | 3/2009 | McNerney | F16K 11/0743 137/625.11 |
| 8,191,185 | B2 * | 6/2012 | Tsai | E03C 1/06 4/601 |
| 9,663,927 | B2 | 5/2017 | Lo | |
| 10,203,038 | B2 * | 2/2019 | Lin | E03C 1/0408 |
| 10,641,400 | B2 * | 5/2020 | Gong | E03C 1/02 |
| 10,967,390 | B2 * | 4/2021 | Lord | B05B 1/18 |
| 2006/0242759 | A1 * | 11/2006 | Tsai | E03C 1/06 4/605 |
| 2018/0216740 | A1 * | 8/2018 | Breda | F16K 11/0856 |

* cited by examiner

*Primary Examiner* — Steven J Ganey
(74) *Attorney, Agent, or Firm* — Karin L. Williams; Alan D. Kamrath; Mayer & Williams PC

(57) ABSTRACT

A faucet is provided with a diverter. The diverter includes a body, an inlet module, two outlet modules and a control module. The inlet module is connected to the body. The outlet module is connected to the body. The control module is connected to the body. The control module is operable to switch between directions and modes for supply water. Each of the modules includes a small number of components. The diverter can be taken apart for repair because the modules are not interconnected by ultrasonic welding.

8 Claims, 18 Drawing Sheets

DIVERTING APPARATUS OF A FAUCET

BACKGROUND OF INVENTION

1. Field of Invention

The present invention relates to a faucet and, more particularly, to a diverting apparatus of a faucet.

2. Related Prior Art

As disclosed in U.S. Pat. No. 9,663,927B2, a faucet is provided with a conventional diverter including a body, an inlet module, a first outlet module, a second outlet module and a control module. The inlet module is connected to an input portion of the body. The first outlet module is connected to a hose. The angle of the first outlet module is adjustable. The second outlet module is operable to switch between modes for dispensing water. The control module is operable to switch between directions and outlets.

However, it is troublesome to assemble each of the modules because each of the modules includes quite a few components. Finally, it is impossible to take the diverter apart for repair because the modules are interconnected by ultrasonic welding.

The present invention is therefore intended to obviate or at least alleviate the problems encountered in prior art.

SUMMARY OF INVENTION

It is the primary objective of the present invention to provide a faucet with a diverter.

To achieve the foregoing objective, the diverter includes a body, an inlet module, an outlet module and a control module. The body includes first, second, third and fourth tubular branches and a partition. The first tubular branch includes a central tube and a peripheral zone. The partition extends in the body and includes two apertures. The fourth tubular branch is in communication with the central tube of the first tubular branch via the first aperture. The fourth tubular branch is in communication with the peripheral zone of the first tubular branch via the second aperture. The third tubular branch is in communication with the fourth tubular branch via a slot. The inlet module includes a collar connected to the third tubular branch and adaptable for connection to a faucet. The first outlet module includes a ring and a nozzle. The ring is inserted in the first tubular branch and includes a central aperture and peripheral apertures. The central aperture receives a section of the central tube of the first tubular branch. The nozzle is connected to the first tubular branch to keep the ring in the first tubular branch and includes a tubular wall, a central outlet portion and a peripheral outlet portion. The tubular wall includes an edge abutted against an edge of the central tube. The central outlet portion is located corresponding to the central aperture. The peripheral outlet portion is located corresponding to the peripheral apertures. The control module includes a knob and a controller. The controller is inserted in the fourth tubular branch and includes an insert, a water-containing zone and an orifice. The insert is fitted in the knob so that the controller is rotatable with the knob. The water-containing zone is in communication with the third tubular branch via the slot. The orifice is in communication with the water-containing zone. The water-containing zone, the orifice, the first aperture, the first tubular branch, the central tube, the central aperture and the central outlet portion together provide a first channel when the controller is in the first position. The water-containing zone, the orifice, the second aperture, the first tubular branch, the peripheral zone, the peripheral apertures and the peripheral outlet portion together provide a second channel when the controller is in the second position.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
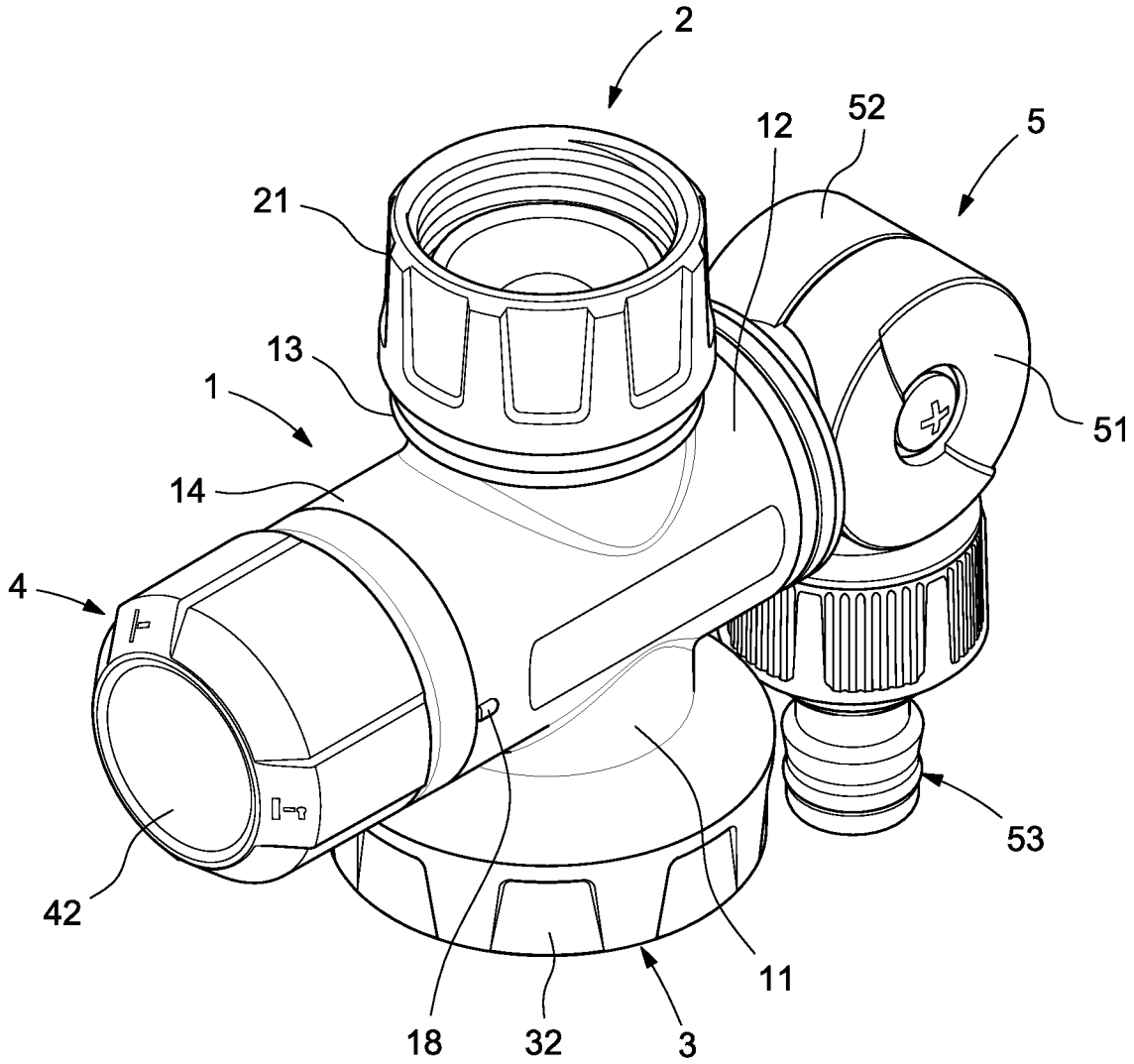
FIG. 1 is a perspective view of a diverter according to the preferred embodiment of the present invention.
Figure 2:
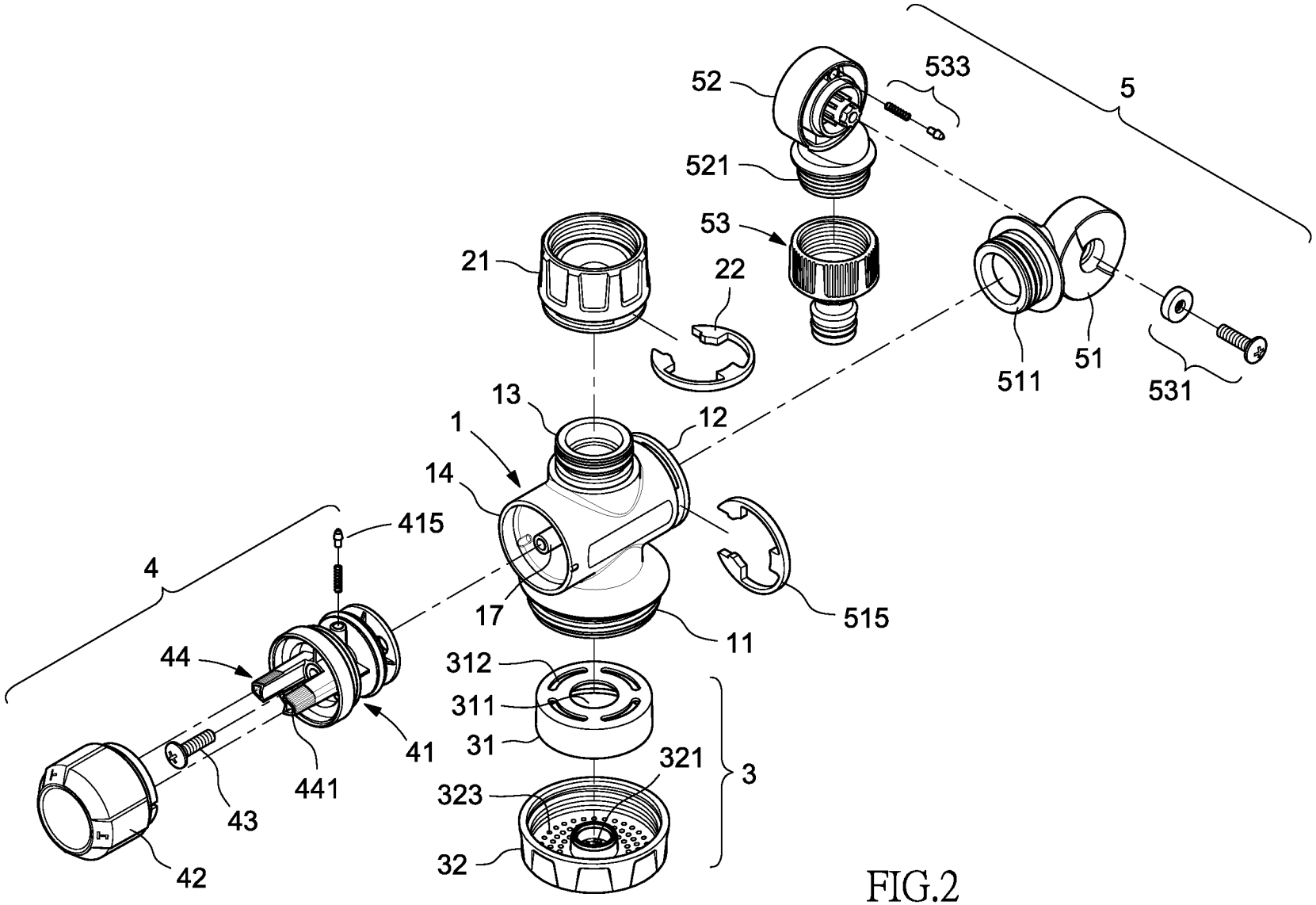
FIG. 2 is an exploded view of the diverter shown in FIG. 1.

Referring to FIGS. 1 through 3 and 10, a diverter includes the body 1, an inlet module 2, a first outlet module 3, a second outlet module 5 and a control module 4 according to the preferred embodiment of the present invention. The body 1 is connected to the inlet module 2, the first outlet modules 3, the second outlet module 5 and the control module 4. Although not shown or described in detail, seals can be used to prevent leak.

The body 1 is made by injection molding. The body 1 includes a first tubular branch 11, a second tubular branch 12, a third tubular branch 13 and a fourth tubular branch 14. The tubular branches 11 to 14 are in communication with one another.

The inlet module 2 includes a collar 21 and a clip 22. The collar 21 is made by injection molding, and so is the clip 22. The collar 21 is used to connect a hose (not shown) to the body 1. The clip 22 is used to connect the collar 21 to the third tubular branch 13.

The first outlet module 3 includes a ring 31 and a nozzle 32. The ring 31 is made by injection modeling, and so is the nozzle 32. The ring 31 includes a central aperture 311 and peripheral apertures 312. The nozzle 32 includes a central outlet portion 321, a tubular wall 322 and a peripheral outlet portion 323. The central outlet portion 321 is located in the tubular wall 322. The peripheral outlet portion 323 extends around the tubular wall 322.

The ring 31 is inserted in the first tubular branch 11, around a central tube 111 formed in the first tubular branch 11. The nozzle 32 is provided around the first tubular branch 11. Thus, the central tube 111 includes a section inserted in the central aperture 311 and an edge abutted against an edge of the tubular wall 322, which extends around the central outlet portion 321. The central outlet portion 321 is aligned to the central aperture 311. The peripheral outlet portion 323 is aligned to the peripheral apertures 312. The nozzle 32 includes, on an internal face, a thread (not numbered) engaged with a thread (not numbered) formed on an external face of the first tubular branch 11, thereby connecting the nozzle 32 to the first tubular branch 11.

Figure 3:
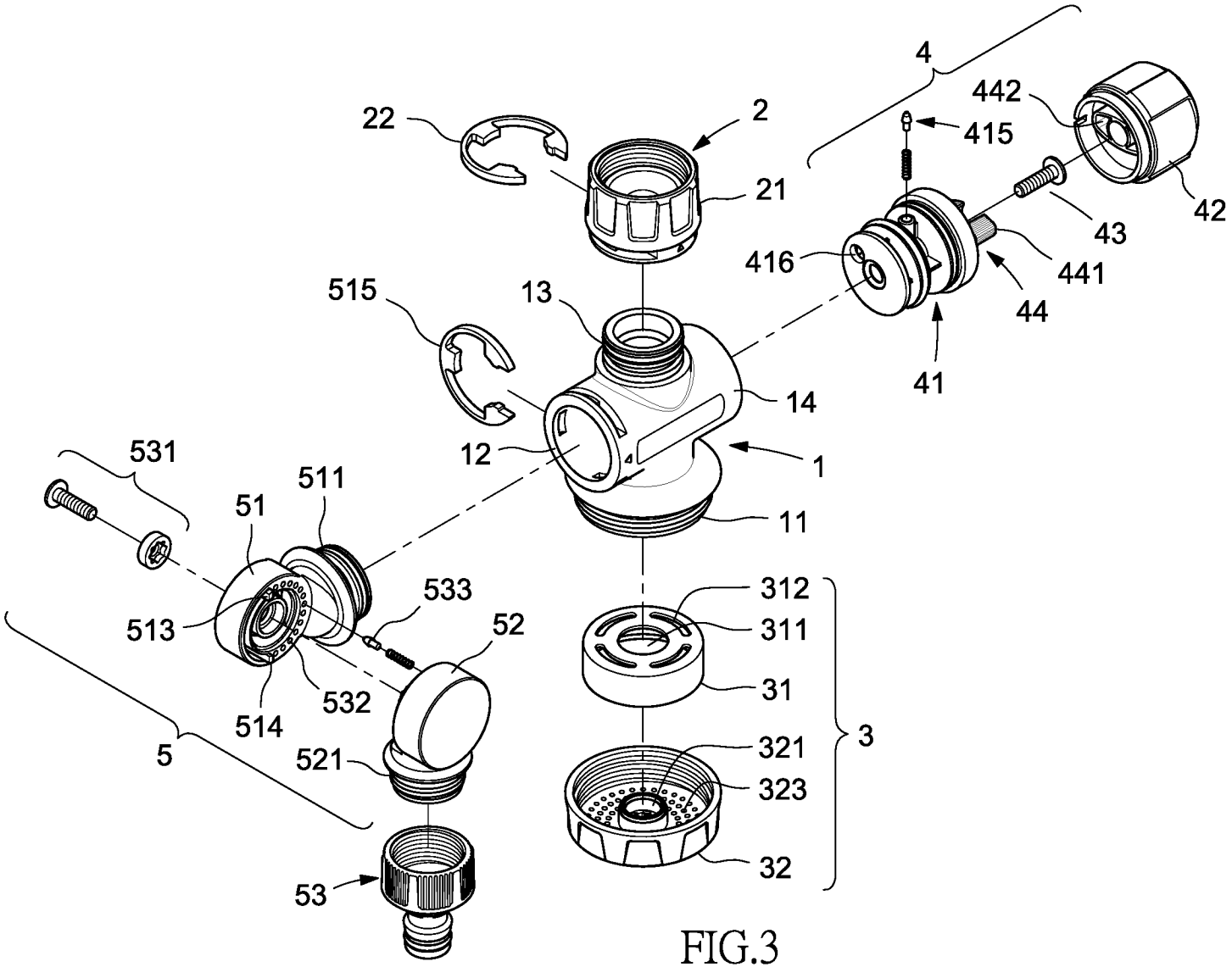
FIG. 3 is another exploded view of the diverter shown in FIG. 1.
Figure 9:
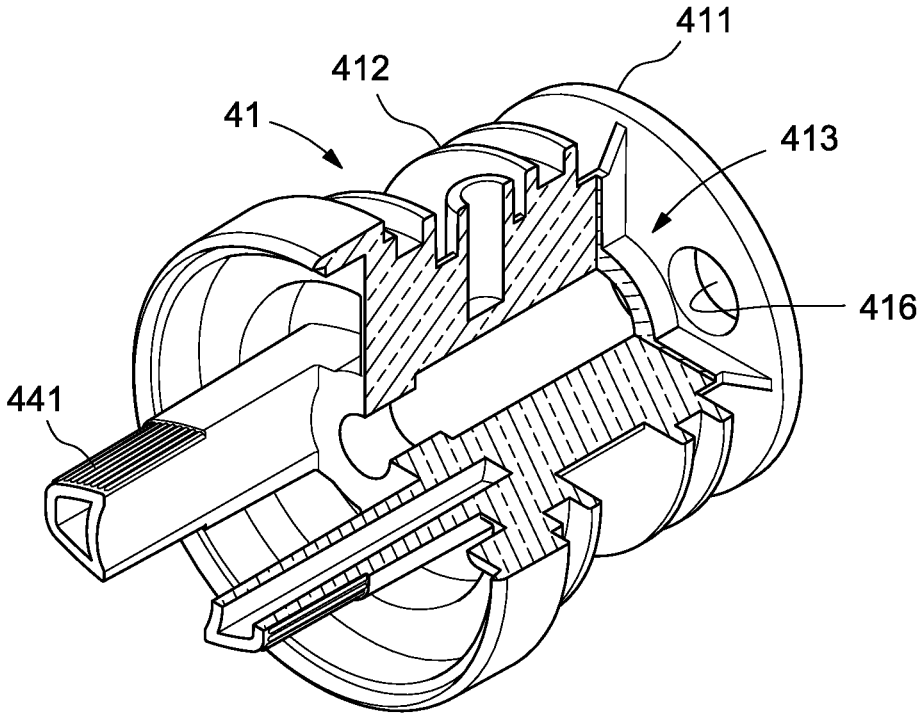
FIG. 9 is a cut-away view of the diverter shown in FIG. 8.

The control module 4 includes a controller 41 and a knob 42. The controller 41 is made by injection modeling, and so is the knob 42. The controller 41 is inserted in the fourth tubular branch 14. A screw 43 is used to rotationally connect the controller 41 to a tubular portion 17 formed in the fourth tubular branch 14. The controller 41 includes an insert 44 fitted in a bore 442 made in the knob 42 so that the controller 41 is rotatable with the knob 42. Referring to FIGS. 3 and 9, the insert 44 includes an anti-skid portion 441 in contact with an anti-skid portion (not numbered) formed on the wall of the bore 442 made in the knob 42, thereby keeping the insert 44 in the bore 42, and ensuring that the controller 41 be rotatable with the knob 42.

Figure 19:
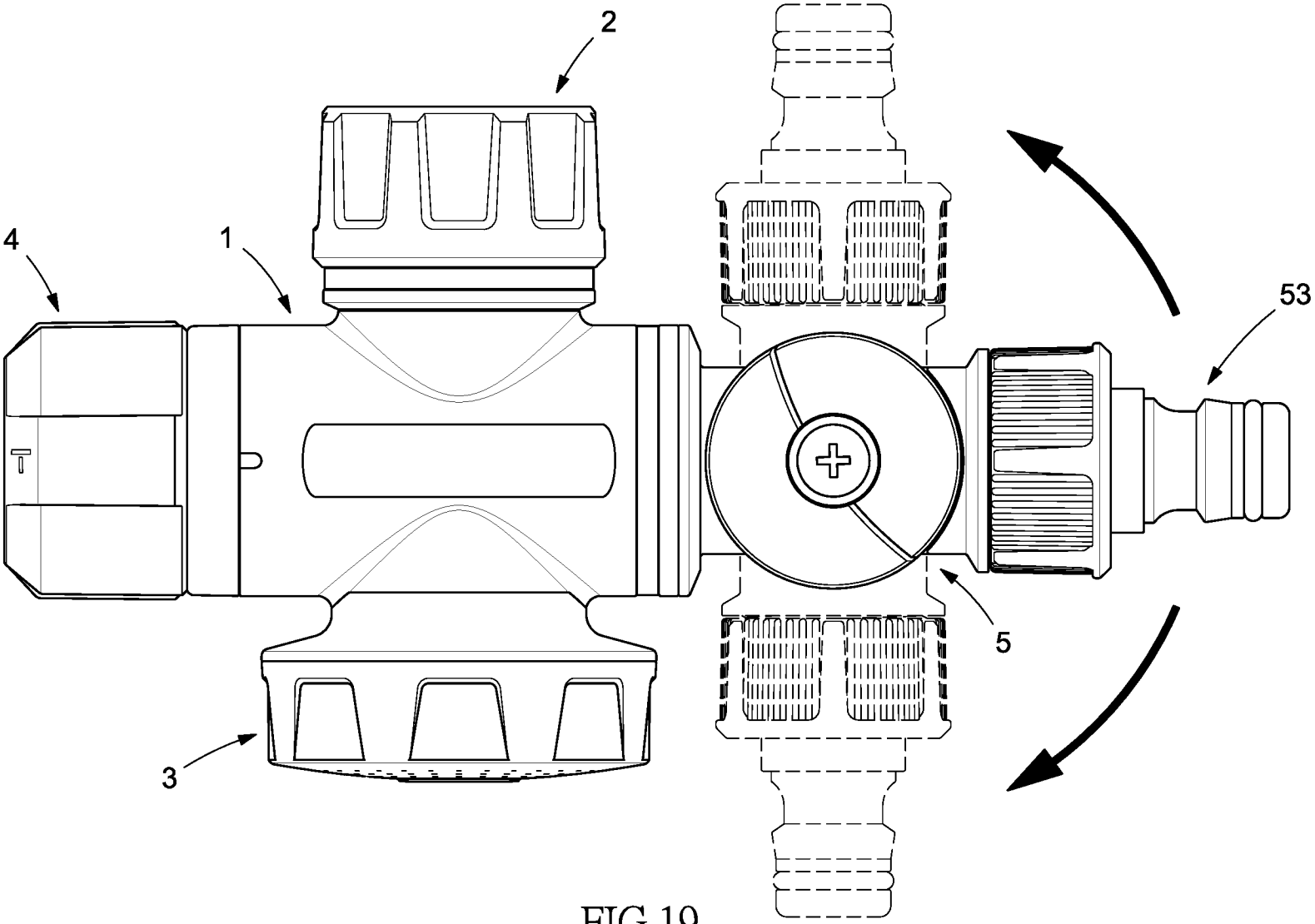
FIG. 19 is a side view of the diverter shown in FIG. 1.

The second outlet module 5 includes a stationary hollow element 51, a rotational hollow element 52 and a joint 53. The stationary hollow element 51, the rotational hollow element 52 and the joint 53 are made by injection modeling. The stationary hollow element 51 includes a tubular portion 511 connected to the second tubular branch 12 by a clip 515. The rotational hollow element 52 includes a tubular portion 521 formed with a thread (not numbered) engaged with a thread (not numbered) formed on the joint 53. The joint 53 includes a reduced section inserted in a hose (not shown) in use. The rotational hollow element 52 is rotationally connected to the stationary hollow element 51 by an axle 531. The axle 531 is preferably a threaded bolt used with a washer. The rotational hollow element 52 is rotatable relative to the stationary hollow element 51 so that the angle of the joint 53 relative to the stationary hollow element 51 is changeable (FIG. 19). The stationary hollow element 51 includes a face formed with cavities 532. A spring-biased detent 533 is supported on a face of the rotational hollow element 52. When the rotational hollow element 52 is rotatable relative to the stationary hollow element 51, the spring-biased detent 533 enters and leaves the cavities 532 one after another so that the rotational hollow element 52 rattles on the stationary hollow element 51. Elastically, the spring-biased detent 533 is inserted in one of the cavities 532 to keep the rotational hollow element 52 in one of several angles relative to the stationary hollow element 51.

Figure 4:
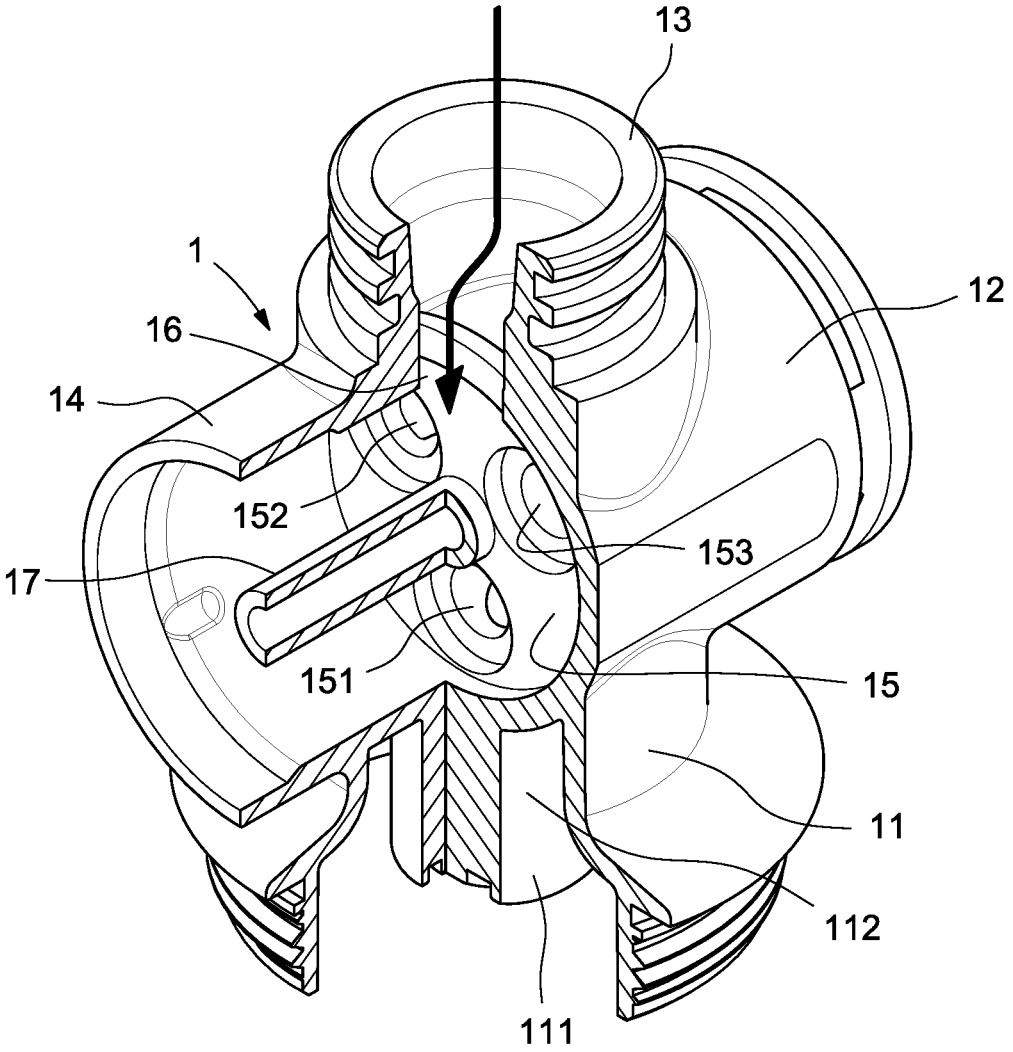
FIG. 4 is a cut-away view of the diverter shown in FIG. 1.

Referring to FIG. 4, a partition 15 is formed in the body 1. The partition 15 includes a first aperture 151, a second aperture 152 and a third aperture 153. The third tubular branch 13 is in communication with the fourth tubular branch 14 via a slot 16 made in the body 1. Hence, water is only allowed to go into the fourth tubular branch 14 and the control module 4 from the inlet module 2, which is connected to a faucet in operation. The partition 15 includes a tubular portion 17 for receiving the screw 43 that includes a section inserted in the controller 41 of the control module 4.

Figure 5:
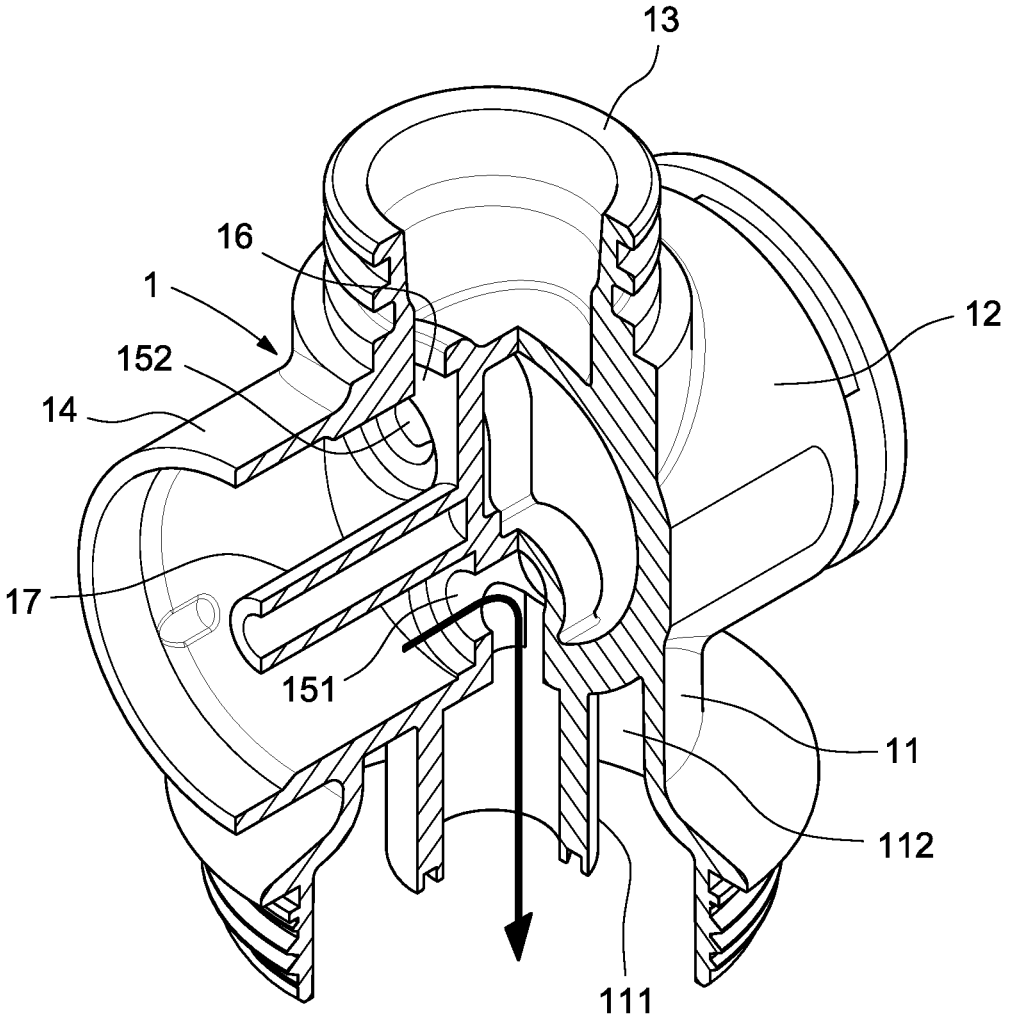
FIG. 5 is a cut-away view of the diverter shown in FIG. 1.

Referring to FIG. 5, the fourth tubular branch 14 is in communication with the central tube 111 of the first tubular branch 11 via the first aperture 151.

Figure 6:
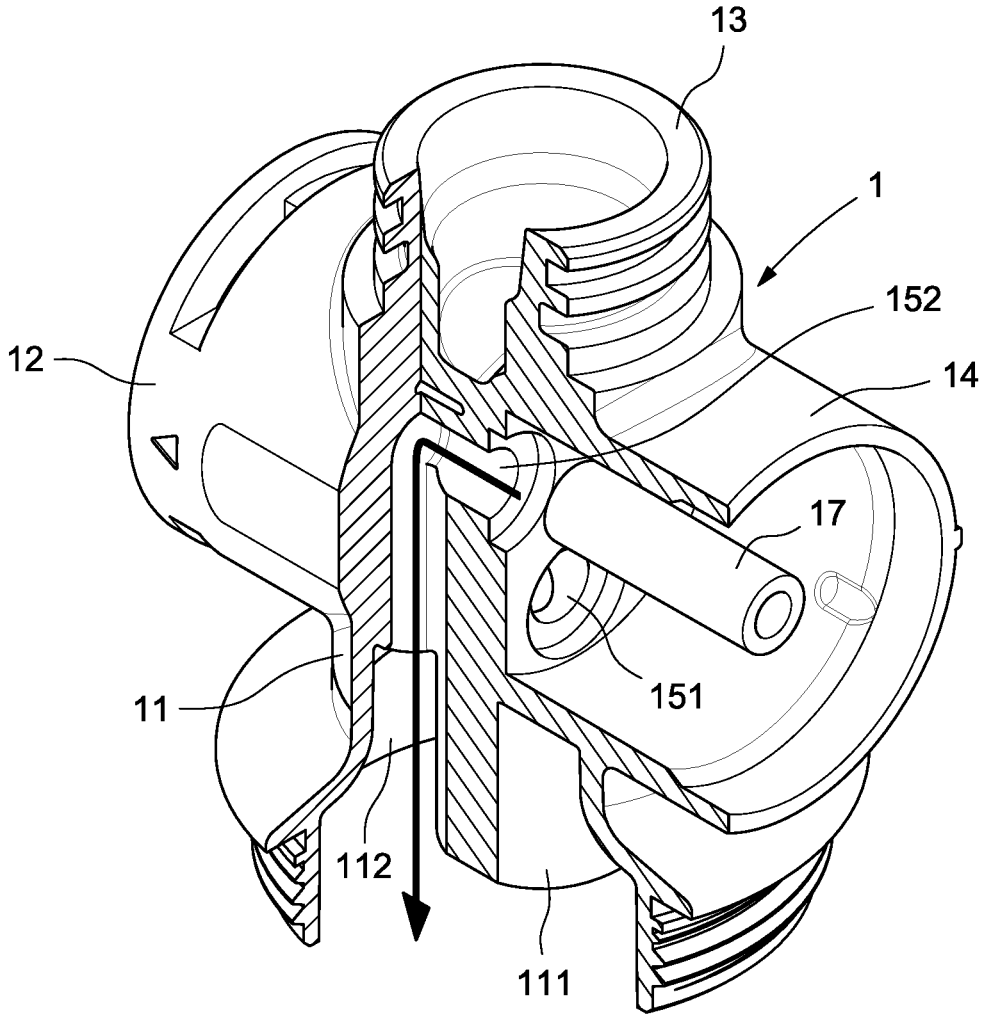
FIG. 6 is a cut-away view of the diverter shown in FIG. 1.

Referring to FIG. 6, the fourth tubular branch 14 is in communication with a peripheral zone 112 of the first tubular branch 11 through the second aperture 152.

Figure 7:
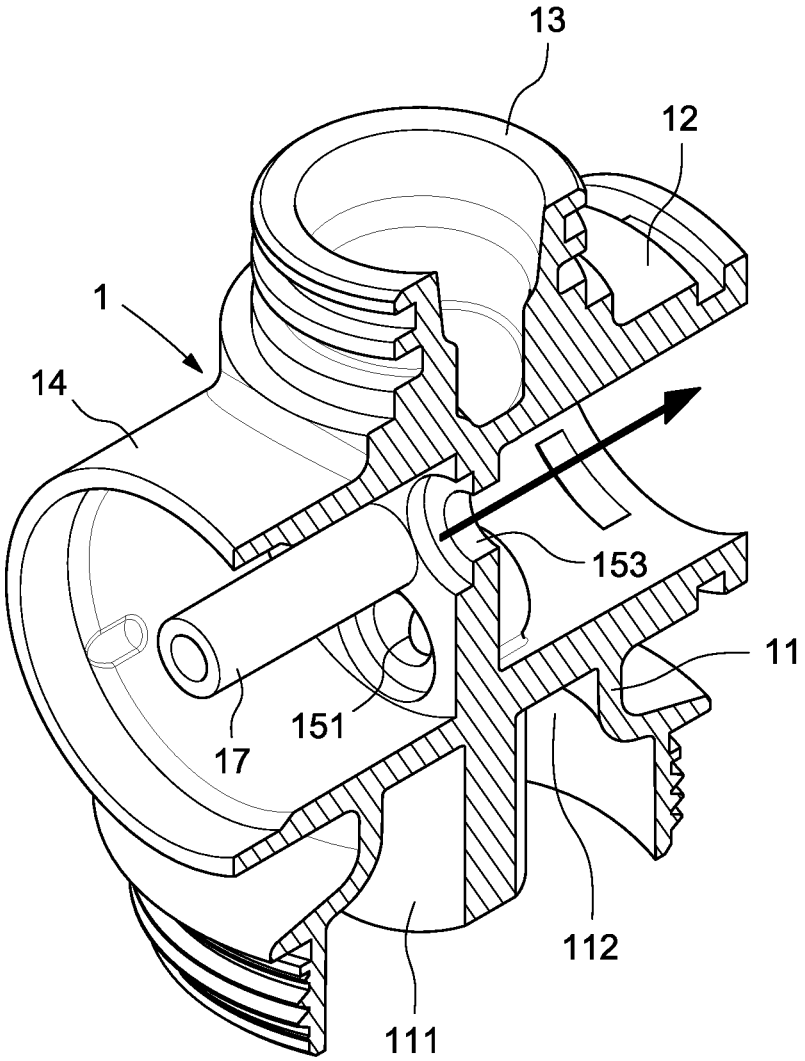
FIG. 7 is a cut-away view of the diverter shown in FIG. 1.

Referring to FIG. 7, the fourth tubular branch 14 is in communication with the second tubular branch 12 via the third aperture 153.

Figure 8:
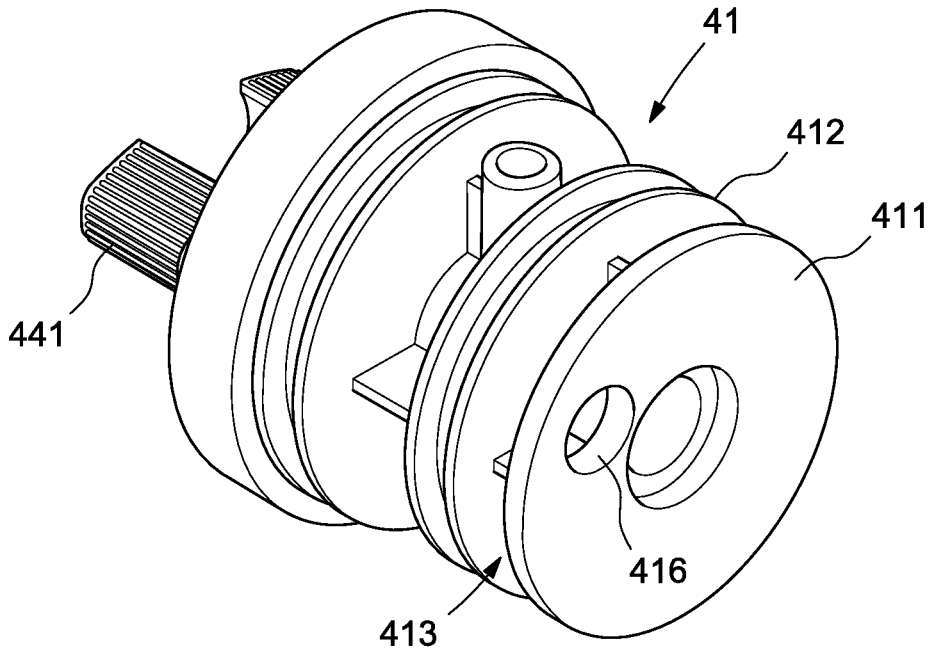
FIG. 8 is a perspective view of a controller of the diverter illustrated in FIG. 1.
Figure 10:
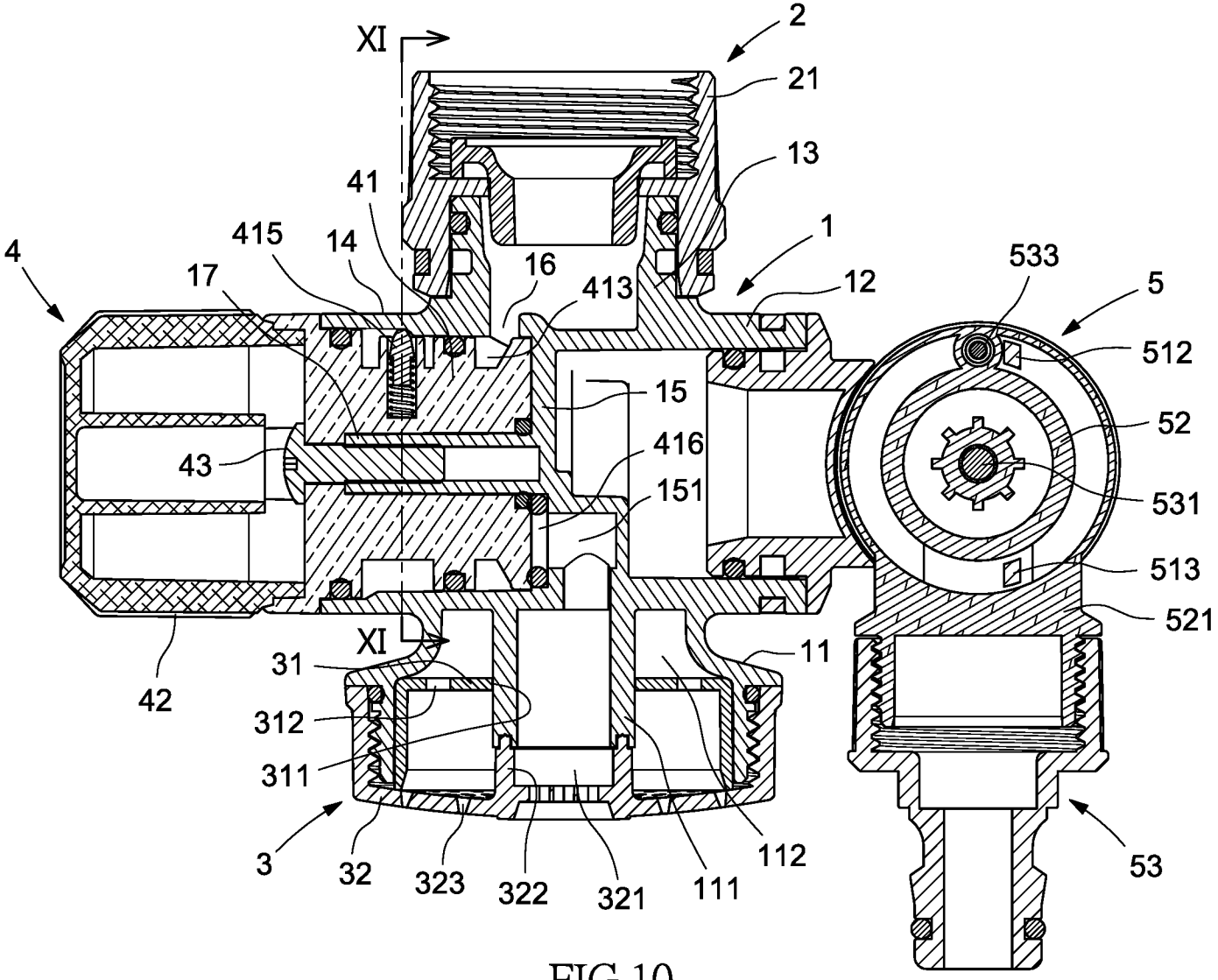
FIG. 10 is a cross-sectional view of the diverter shown in FIG. 1.

Referring to FIGS. 8 through 10, a first flange 411 and a second flange 412 are formed on a side of the controller 41 of the control module 4 pointed at the partition 15 of the body 1. A water-containing zone 413 is a gap between the first flange 411 and the second flange 412. The water-containing zone 413 is in communication with the third tubular branch 13 via the slot 16. The second flange 412 includes an orifice 416 at a point other than a center of the second flange 412.

Figure 11:
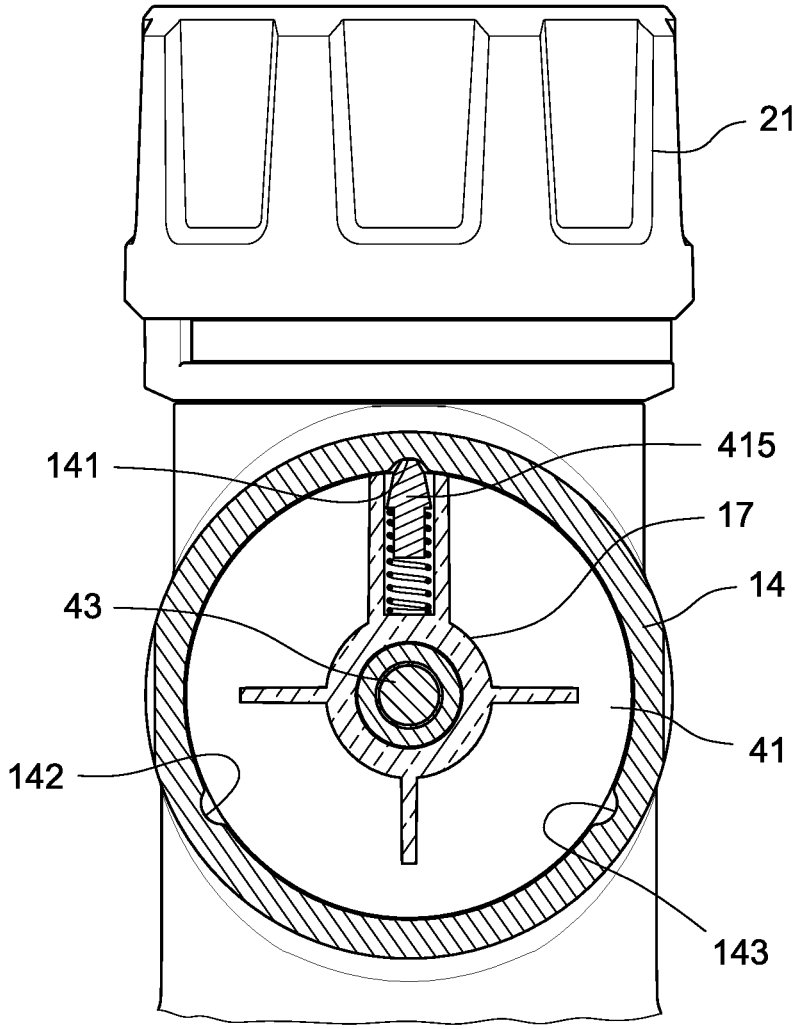
FIG. 11 is a cross-sectional view of the diverter taken along a line XI-XI shown in FIG. 10.

Referring to FIGS. 8, 10 and 11, a spring-biased detent 415 is supported on the periphery of the controller 41. A first recess 141, a second recess 142 and a third recess 143 are made in an internal face of the fourth tubular branch 14. The spring-biased detent 415 is elastically inserted in the first recess 141, the second recess 142 or the third recess 143 selectively.

Figure 12:
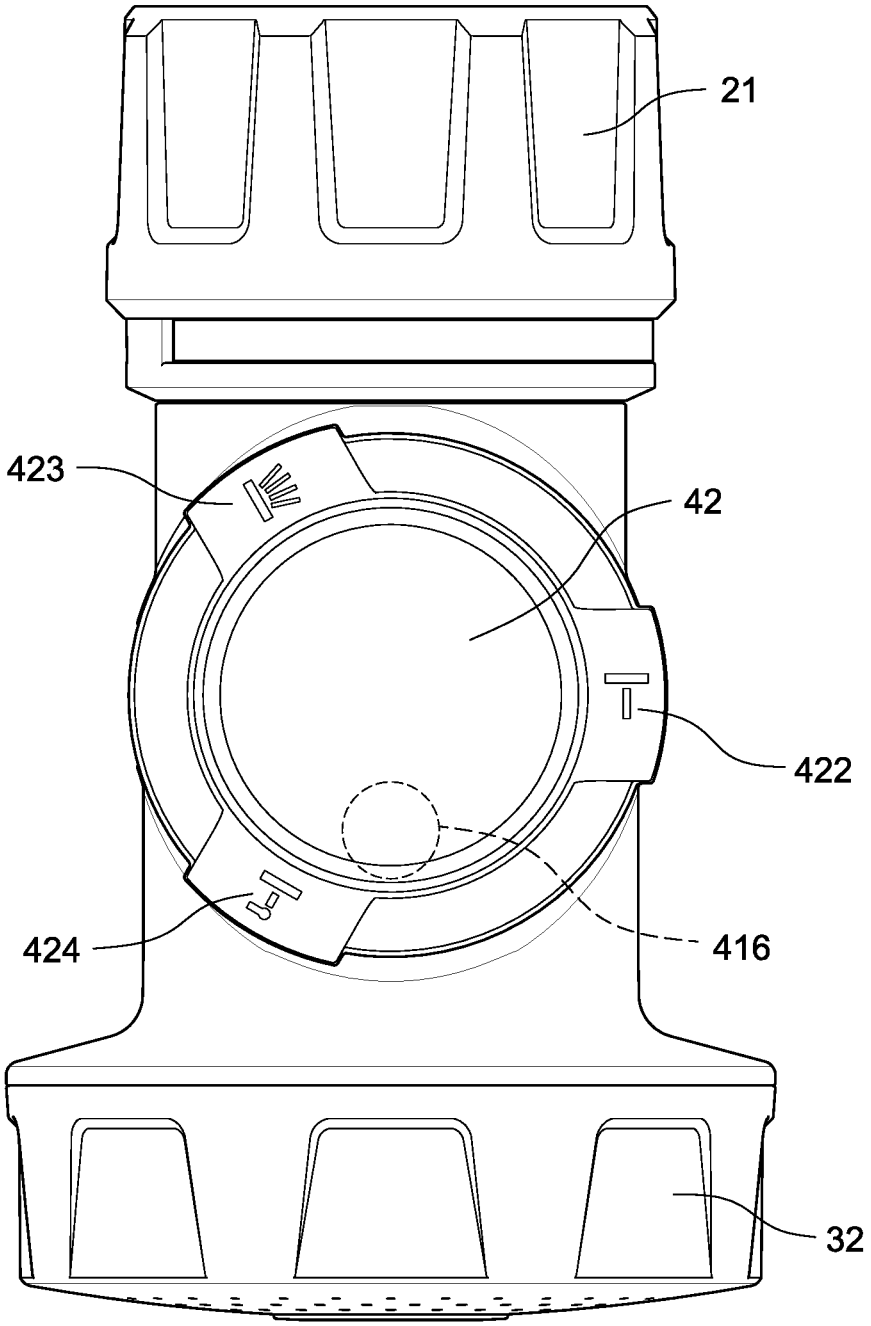
FIG. 12 is a side view of the diverter shown in FIG. 1, in a first mode for dispensing water.
Figure 13:
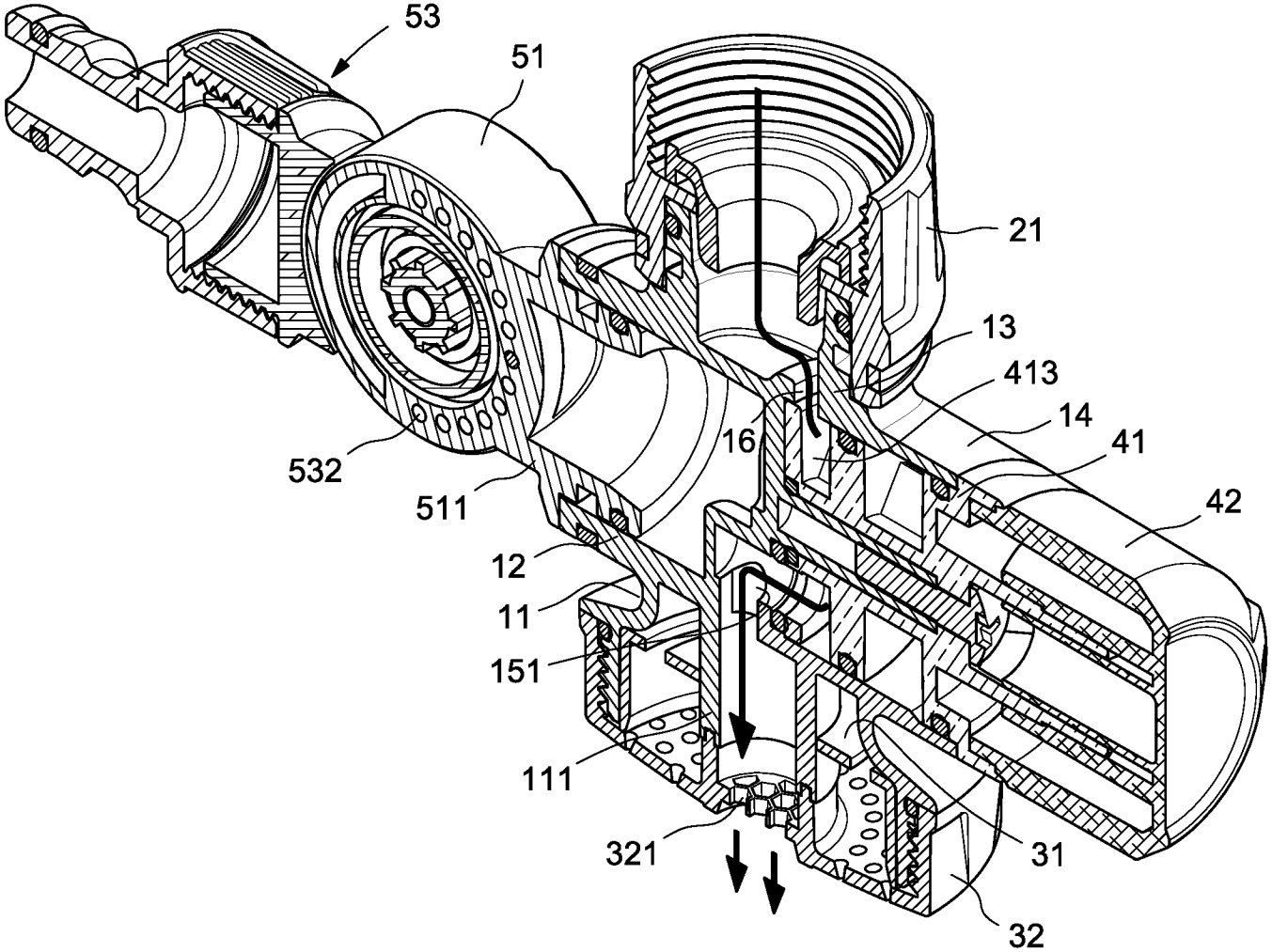
FIG. 13 is a cut-away view of the diverter shown in FIG. 1.

Referring to FIGS. 12 and 13, the knob 42 is operable to switch the diverter between directions and modes for dispensing water. The knob 42 includes a water-column mark 422, a spray mark 423 and a hose mark 424 at an end.

The knob 42 is in a position where the water-column mark 422 is aligned to an indicator 18 formed on the body 1 (FIG. 1) and the spring-biased detent 415 is elastically inserted in the first recess 141. Now, the orifice 416 is in communication with the first aperture 151, the water-containing zone 413, the orifice 416, the first aperture 151, the first tubular branch 11, the central tube 111, the central aperture 311 and the central outlet portion 321, thereby providing a first channel. Thus, water goes into the central outlet portion 321 from the inlet module 2 through the third tubular branch 13, the slot 16, the water-containing zone 413, the orifice 416, the first aperture 151 and the central tube 111, which extends through the central aperture 311. Finally, the water goes out of the central outlet portion 321 via apertures (not numbered) made in the central outlet portion 321. The water goes leaves the central outlet portion 321 in the form of a column because the arrangement of the apertures in the central outlet portion 323 is relatively concentrated.

Figure 14:
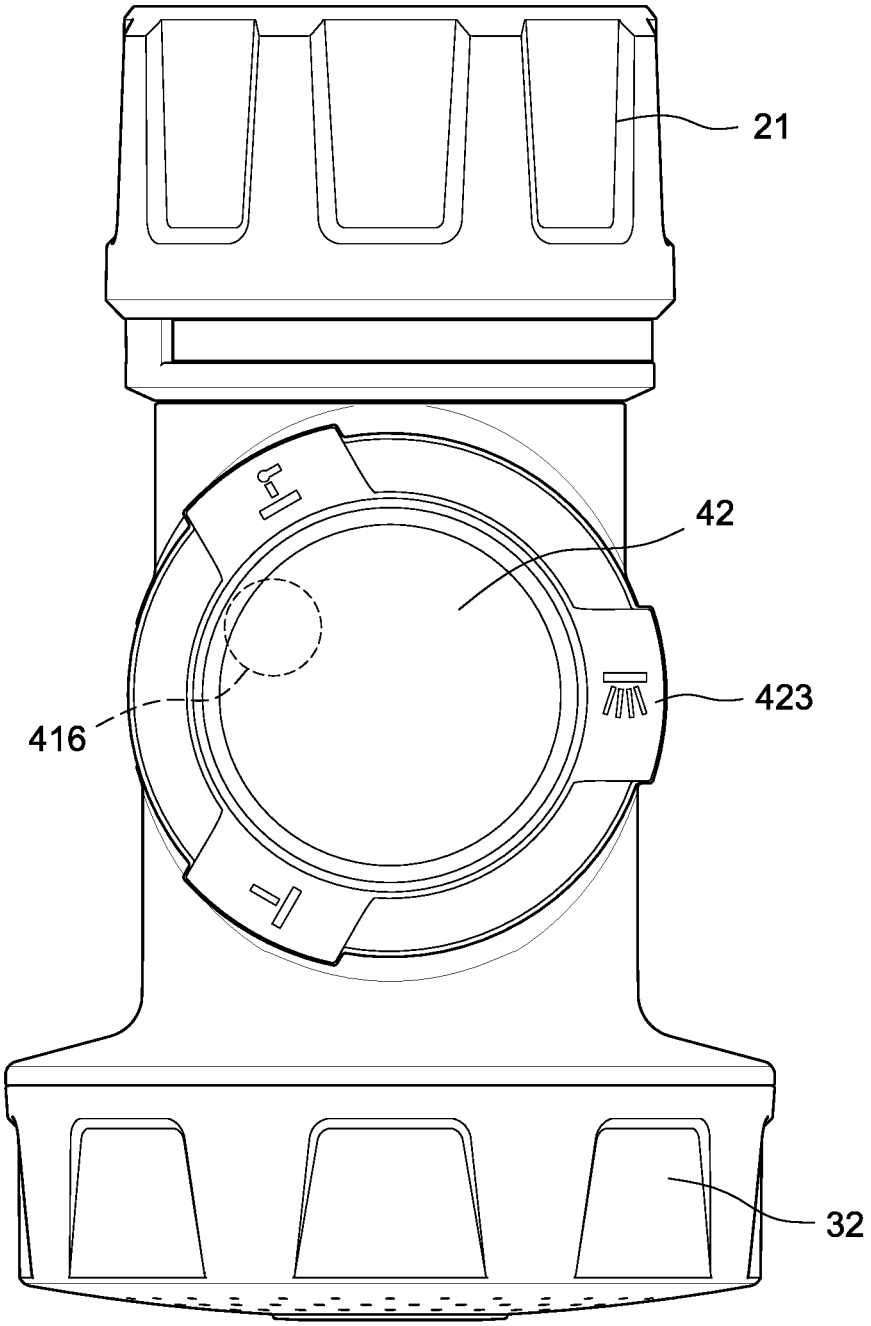
FIG. 14 is a side view of the diverter shown in FIG. 1, in a second mode for dispensing water.
Figure 15:
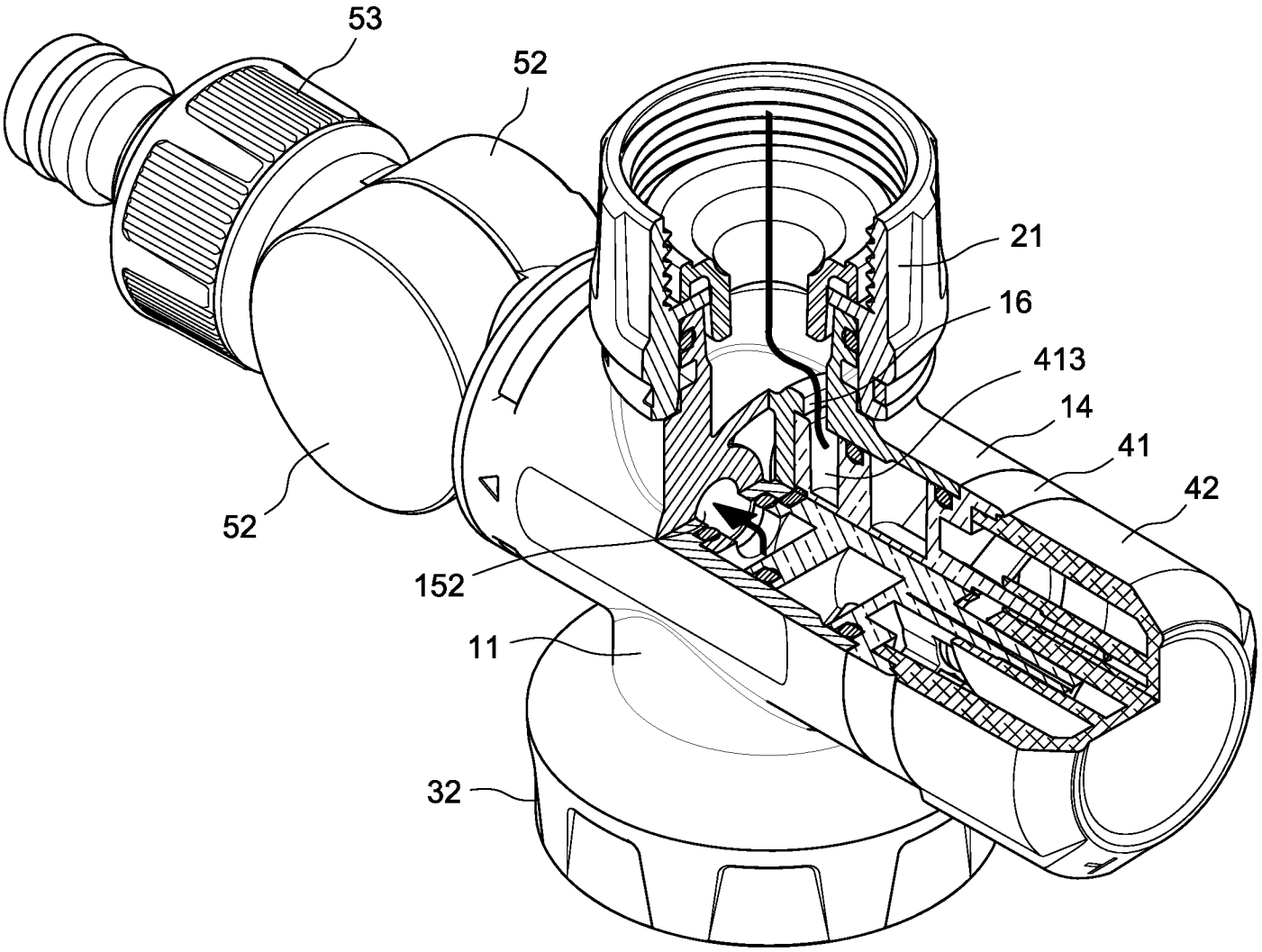
FIG. 15 is a cut-away view of the diverter shown in FIG. 14.
Figure 16:
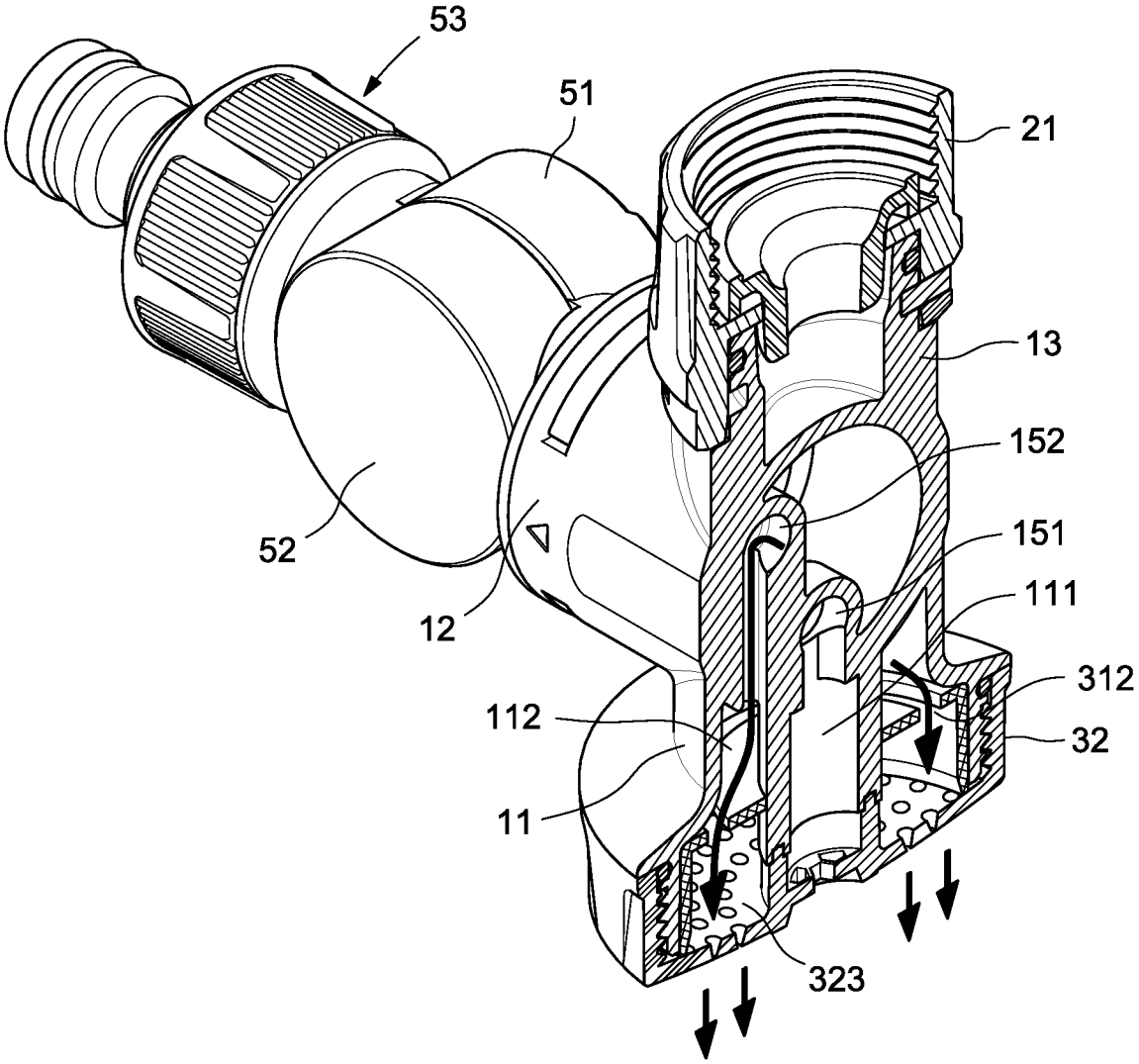
FIG. 16 is another cut-away view of the diverter shown in FIG. 14.

Referring to FIG. 14 through 16, the knob 42 is in another position where the spray mark 423 is aligned to the indicator 18 (FIG. 1) and the spring-biased detent 415 is elastically inserted in the second recess 142. Now, the orifice 416 is in communication with the second aperture 152, the water-containing zone 413, the orifice 416, the second aperture 152, the first tubular branch 11, the peripheral zone 112, the peripheral apertures 312 and the peripheral outlet portion 323, thereby providing a second channel. Thus, water enters the peripheral outlet portion 323 from the inlet module 2 through the third tubular branch 13, the slot 16, the water-containing zone 413, the orifice 416, the second aperture 152, the peripheral zone 112 and the peripheral apertures 312. Finally, the water goes out of the peripheral outlet portion 323 via apertures (not numbered) made in the peripheral outlet portion 323. The water goes out of the peripheral outlet portion 323 in the form of spray because the arrangement of the apertures in the peripheral outlet portion 323 of the nozzle 32 is relatively diverse.

Figure 17:
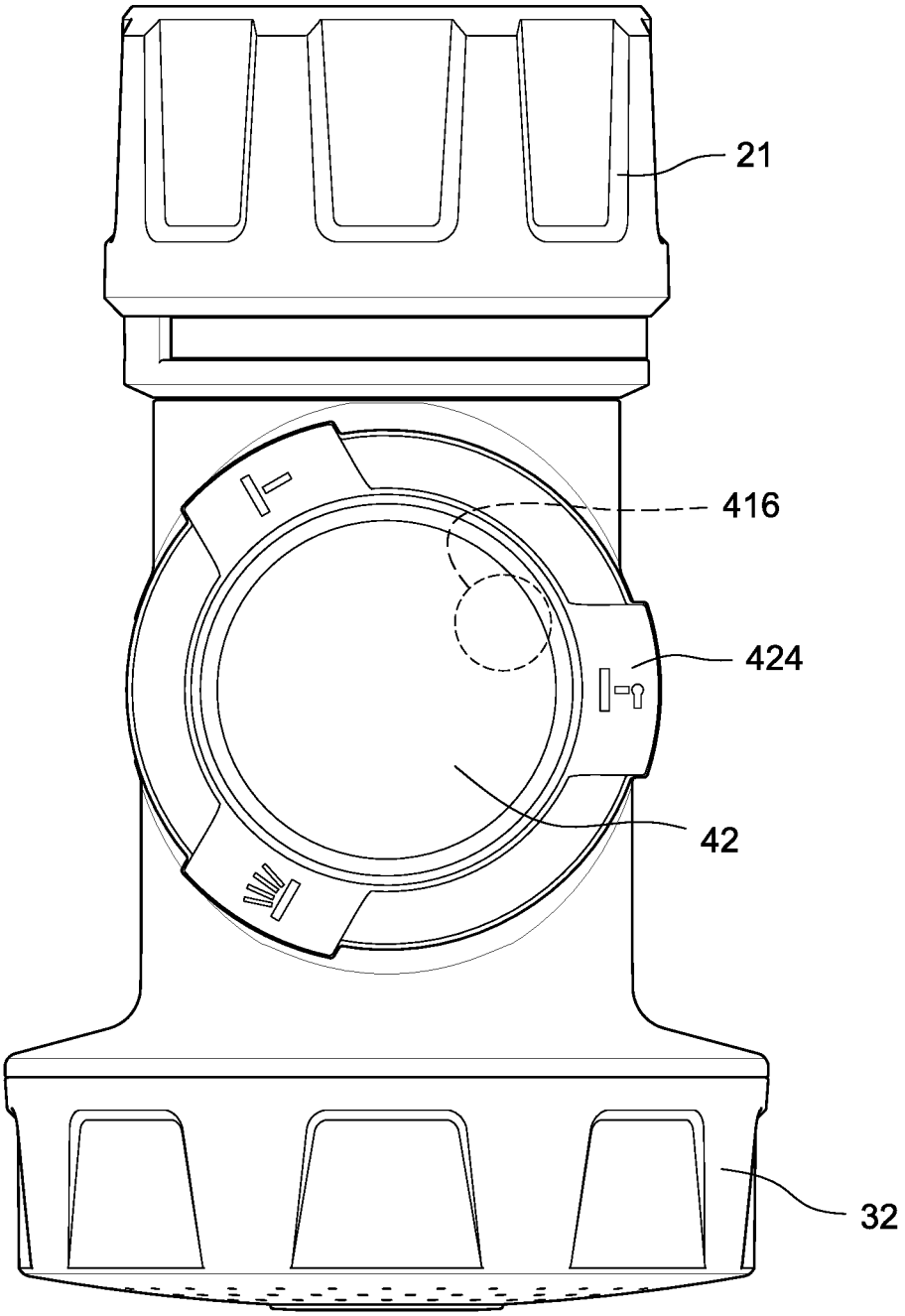
FIG. 17 is a side view of the diverter shown in FIG. 1, in another mode for dispensing water.
Figure 18:
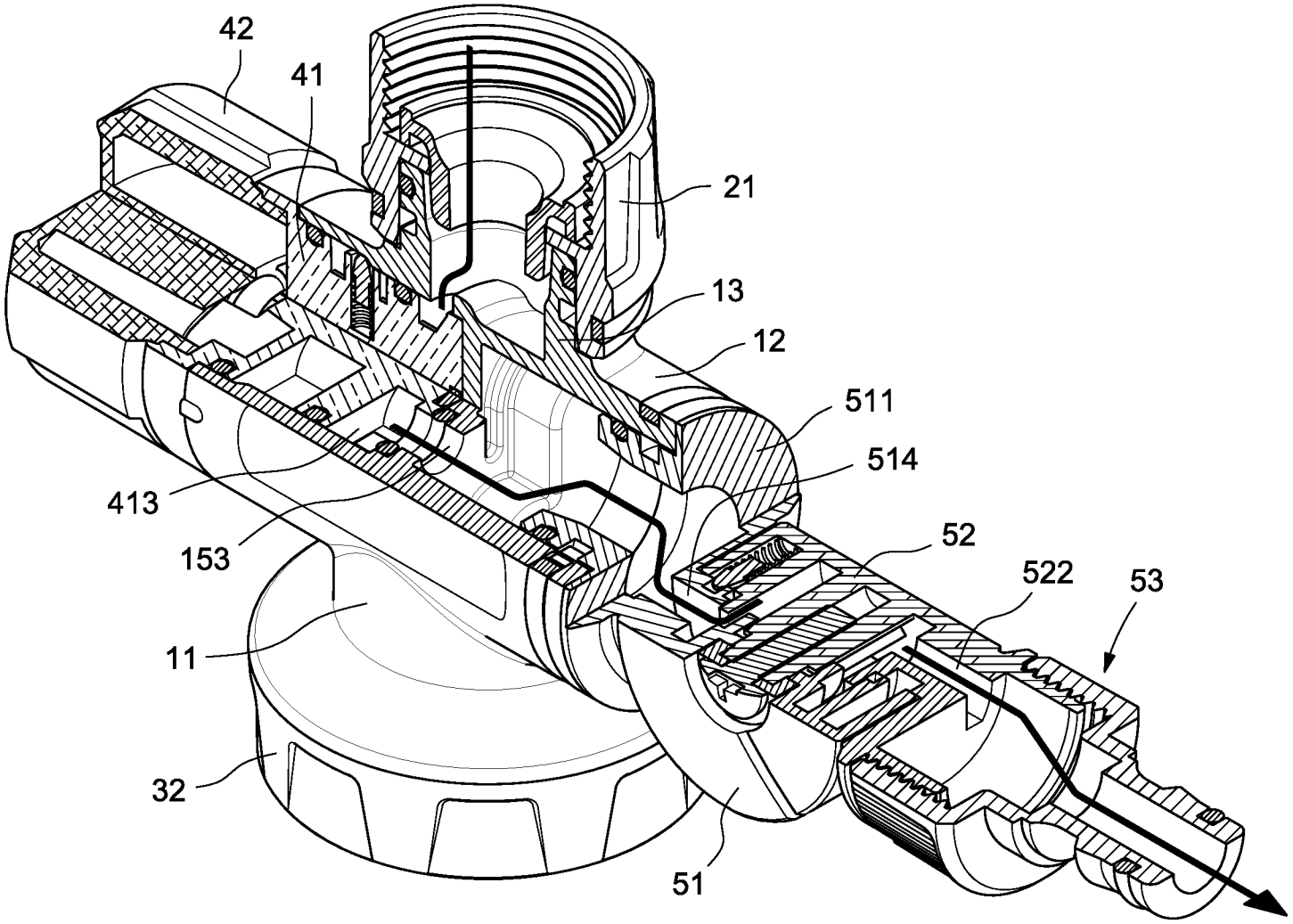
FIG. 18 is a cut-away view of the diverter shown in FIG. 17.

Referring to FIGS. 17 and 18, the knob 42 is in another position where the hose mark 424 is aligned to the indicator 18 (FIG. 1) and the spring-biased detent 415 is elastically inserted in the third recess 143. Now, the orifice 416 is in communication with the third aperture 153, the water-containing zone 413, the orifice 416, the third aperture 153, the second tubular branch 12, a passage 514 made in the stationary hollow element 51 (in communication with the second tubular branch 12) and a passage 522 made in the rotational hollow element 52 (in communication with the passage 514 and the joint 53), thereby providing a third channel. Thus, water travels into the second tubular branch 12 from the inlet module 2 through the third tubular branch 13, the slot 16, the water-containing zone 413, the orifice 416 and the third aperture 153. Then, the water travels into the joint 53 from the second tubular branch 12 via the passage 514 and the passage 522. Finally, the water leaves the joint 53.

Referring to FIG. 19, the rotational hollow element 52 is rotatable to change the angle of the joint 53. Referring to FIG. 10, a first stop 512 and the second stop 513 are formed on a face of the stationary hollow element 51 pointed at the rotational hollow element 52. There is an angle of 180 degrees between the first stop 512 and the second stop 513. The rotation of the rotational hollow element 52 is limited to 180 degrees. The rotation of the rotational hollow element 52 reaches a limit when the spring-biased detent 533 abuts against the first stop 512. The rotation of the rotational hollow element 52 reaches another limit when the spring-biased detent 533 abuts against the second stop 513.

As discussed above, the control module 4 is operable to switch the diverter between directions and modes for dispensing water. Water goes from the first outlet module 3 as a water column, leaves the first outlet module 3 in water spray, or goes out of the hose, which is connected to the second outlet module 5. The components of the body 1, the inlet module 2, the first outlet module 3, the second outlet module 5 and the control module 4 are made by injection modeling. Hence, the production of the components is relatively easy. Moreover, the total number of the components is relatively small. Therefore, the assembly of the diverter is relatively easy and precise. Risks of leak are reduced. In addition, ultrasonic welding is not used so that the diverter can be taken apart for repair.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A diverter comprising:

a body comprising:

a first tubular branch comprising a central tube and a peripheral zone;

a second tubular branch;

a third tubular branch;

a fourth tubular branch;

a partition extending in the body and comprising:

a first aperture via which the central tube of the first tubular branch is in communication with the fourth tubular branch; and a second aperture via which the peripheral zone of the first tubular branch is in communication with the fourth tubular branch;

a slot via which the third tubular branch is in communication with the fourth tubular branch;

an inlet module comprising a collar connected to the third tubular branch and adaptable for connection to a faucet;

a first outlet module comprising:

a ring inserted in the first tubular branch, wherein the ring comprises:

a central aperture for receiving a section of the central tube of the first tubular branch; and peripheral apertures; and a nozzle connected to the first tubular branch to keep the ring in the first tubular branch, wherein the nozzle comprises:

a tubular wall formed with an edge abutted against an edge of the central tube;

a central outlet portion corresponding to the central aperture; and a peripheral outlet portion corresponding to the peripheral apertures; and a control module comprising:

a knob;

a controller inserted in the fourth tubular branch and connected to the knob so that the controller is rotatable with the knob between a first position and a second position, wherein the controller comprises:

a water-containing zone in communication with the third tubular branch via the slot; and an orifice in communication with the water-containing zone;

wherein the water-containing zone, the orifice, the first aperture, the first tubular branch, the central tube, the central aperture and the central outlet portion together provide a first channel when the controller is in the first position, wherein the water-containing zone, the orifice, the second aperture, the first tubular branch, the peripheral zone, the peripheral apertures and the peripheral outlet portion together provide a second channel when the controller is in the second position, and wherein the stationary hollow element comprises cavities, and the rotational hollow element comprises a first spring-biased detent that enters and leaves the cavities one after another so that the rotational hollow element rattles on the stationary hollow element when the rotational hollow element rotates relative to the stationary hollow element.

2. The diverter according to claim 1, wherein the fourth tubular branch comprises a first recess and a second recess in an internal face, wherein the controller comprises a second spring-biased detent supported thereon, wherein the controller is kept in the first position when the second spring-biased detent is inserted in the first recess, wherein the controller is kept in the second position as the second spring-biased detent is inserted in the second recess.

3. The diverter according to claim 2, further comprising a second outlet module comprising:

a stationary hollow element comprising a tubular portion connected to the second tubular branch of the body and a passage via which the stationary hollow element is in communication with the second tubular branch;

a rotational hollow element comprising a tubular portion and a passage in communication with the passage of the stationary hollow element;

a joint connected to the tubular portion of the rotational hollow element so that the joint is in communication with the passage of the rotational hollow element; and an axle inserted in the rotational hollow element and the stationary hollow element so that the rotational hollow element is rotatable relative to the stationary hollow element to change an angle of the joint relative to the stationary hollow element;

wherein the fourth tubular branch comprising a third recess for receiving the second spring-biased detent;

wherein the partition comprises a third aperture;

wherein the water-containing zone, the orifice, the third aperture, the second tubular branch, the passage of the stationary hollow element and the passage of the rotational hollow element and the joint together provide a third channel when the control module is rotatable to a position where the second spring-biased detent is elastically inserted in the third recess.

4. The diverter according to claim 3, wherein the knob is formed with a bore, wherein the controller comprises an insert fitted in the knob so that the controller is rotatable with the knob.

5. The diverter according to claim 4, wherein the knob comprises an anti-skid portion formed on a wall of the bore, and the insert comprises an anti-skid portion in contact with the anti-skid portion of the knob.

6. The diverter according to claim 3, wherein the body further comprises a tubular portion formed in the fourth tubular branch, wherein the control module further comprises a screw inserted in the controller and the tubular portion of the body to render the controller rotational in the fourth tubular branch.

7. The diverter according to claim 1, wherein the stationary hollow element comprises a first stop and a second stop formed on a face pointed at the rotational hollow element, wherein the rotation of the rotational hollow element relative to the stationary hollow element is limited as the first spring-biased detent abuts against one of the first and second stops.

8. The diverter according to claim 7, wherein the first stop is at 180 degrees from the second stop.

* * * * *